US008789696B2

(12) United States Patent
Imburgia et al.

(10) Patent No.: US 8,789,696 B2
(45) Date of Patent: Jul. 29, 2014

(54) STORAGE, TRANSPORT, DEPLOYMENT AND RETRACTION BAGS FOR LINE AND METHODS THEREOF

(75) Inventors: Samuel J. Imburgia, Webster, NY (US); Michael A. Bayer, Rochester, NY (US)

(73) Assignee: Cord Warden of Rochester, LLC, Webster, NY (US)

( * ) Notice: Subject to any disclaimer, the term of this patent is extended or adjusted under 35 U.S.C. 154(b) by 317 days.

(21) Appl. No.: 13/033,508

(22) Filed: Feb. 23, 2011

(65) Prior Publication Data

US 2011/0203958 A1 Aug. 25, 2011

Related U.S. Application Data

(60) Provisional application No. 61/307,043, filed on Feb. 23, 2010, provisional application No. 61/329,602, filed on Apr. 30, 2010.

(51) Int. Cl.
*B65D 85/00* (2006.01)
*B65H 54/46* (2006.01)
*B65H 55/00* (2006.01)

(52) U.S. Cl.
USPC ..... 206/388; 206/702

(58) Field of Classification Search
USPC ..... 206/388, 702; 383/26, 41, 47, 48, 54, 383/56, 67, 61.3, 61.4, 75, 78, 80, 84, 86, 383/97, 89; 242/159, 171
See application file for complete search history.

(56) References Cited

U.S. PATENT DOCUMENTS

| | | | | |
|---|---|---|---|---|
| 4,688,674 | A * | 8/1987 | Stirtz | 206/388 |
| 5,103,977 | A * | 4/1992 | Douglas | 206/702 |
| 5,868,219 | A | 2/1999 | Sadeck et al. | |
| 6,026,962 | A * | 2/2000 | Witt et al. | 206/702 |
| 6,085,695 | A * | 7/2000 | Miller et al. | 119/795 |
| 8,028,834 | B2 * | 10/2011 | Lill | 206/438 |
| 8,123,027 | B2 * | 2/2012 | Kirkham | 206/3 |
| 2008/0008405 | A1 * | 1/2008 | Limber | 383/61.3 |
| 2009/0050502 | A1 * | 2/2009 | Garson | 206/388 |
| 2010/0096294 | A1 * | 4/2010 | Mask et al. | 206/702 |

* cited by examiner

*Primary Examiner* — Luan K Bui
*Assistant Examiner* — Rafael Ortiz
(74) *Attorney, Agent, or Firm* — LeClairRyan, A Professional Corporation

(57) ABSTRACT

A device and method for the storage, transport, deployment and retraction of line includes a sleeve which defines a storage compartment and has an opening adjacent at least one end. A closure apparatus is disposed in the sleeve adjacent the opening. The closure apparatus is configured to adjust the opening to a position ranging from substantially closed to substantially open. At least one guide mechanism device is connected to the sleeve adjacent one of the opposing ends. The guide mechanism defines a passage for the deployment and retraction of the line.

26 Claims, 10 Drawing Sheets

STORAGE, TRANSPORT, DEPLOYMENT AND RETRACTION BAGS FOR LINE AND METHODS THEREOF

This application claims the benefit of U.S. Provisional Patent Application Ser. No. 61/307,043, filed Feb. 23, 2010, and claims the benefit of U.S. Provisional Patent Application Ser. No. 61/329,602, filed Apr. 30, 2010 which are each hereby incorporated by reference in their entirety.

FIELD

This technology generally relates to storage systems and methods and, in particular, storage, transport, deployment and retraction bags for line and methods thereof.

BACKGROUND

The use of lines, such as electrical extension cords, Christmas tree lights, strand lights, ropes and hoses, at industrial work sites, in home workshops, garages, gardens, etc, is a common practice. Typically, the users of these lines will encounter difficulties in deploying the lines when needed because of their tendency to become entangled.

For example, one type of worker will often simply pile the line into any out-of-the-way space until it is needed for use. When needed, this worker will drag the haphazardly stored line out, finding it severely entangled.

In another example, a worker will carefully organize the line in multiple loops, and hang it as a loose reel on a storage peg at a fixed storage location. When needed, this worker will remove the line and attempt to throw the loose reel out into the open workspace, or deploy it into the workspace. It is common that in spite of the effort by this worker to carefully handle the line, it still becomes entangled when deployed for use. Additionally, it is more difficult to transport the line to the area where it is needed.

SUMMARY

A device for storage, transport, deployment and retraction of line, includes a sleeve which defines a storage compartment and has an opening adjacent at least one end. A closure apparatus is disposed in the sleeve adjacent the opening. The closure apparatus is configured to adjust the opening to a position ranging from substantially closed to substantially open. At least one guide mechanism device is connected to the sleeve adjacent one of the opposing ends. The guide mechanism defines a passage for the deployment and retraction of the line.

A method for making a device for storage, transport, deployment and retraction of line includes providing a sleeve which defines a storage compartment and has an opening adjacent at least one end. A closure apparatus is disposed in the sleeve adjacent the opening and is configured to adjust the opening to a position ranging from substantially closed to substantially open. At least one guide mechanism device is connected to the sleeve adjacent one of the opposing ends and defines a passage for the deployment and retraction of the line.

This technology provides a number of advantages including providing a more efficient and effective bag for the storage, transport, deployment, and retraction of line, such as electrical extension cords, rope, and other cord-like or flexible tubular devices. With this technology, a variety of different types of lines for industrial, commercial, or personal use, can be easily stored, transported, deployed, and retracted with little if any tangling of the line.

BRIEF DESCRIPTION OF THE DRAWINGS

FIG. 4 is an oblong perspective close up view of one example of the storage, transport, deployment and retraction bag, shown in an opened state, an end closure flap with integrated loading mechanism there from;

FIG. 5 is an oblong perspective view of one example of the storage, transport, deployment and retraction bag, shown in an opened state, with a mesh fabric end, nylon drawstring, and plastic cord lock there from;

FIG. 6 is a oblong perspective view of one example of the storage, transport, deployment and retraction bag, shown in a closed state, with one end zippered closed, and showing outside flap handle, and female end of snap lock there from;

FIG. 7 is a oblong perspective view of one example of the storage, transport, deployment and retraction bag, shown in a closed state, with one end zippered closed, and showing outside flap handle, and male end of snap lock there from;

FIG. 8 is a lateral perspective view of one example of the storage, transport, deployment and retraction bag, shown in an opened state with line partially deployed from both ends, and secured in loading system, and closure flaps secured to each other by plastic snap lock with loading system attached directly to flaps there from;

DETAILED DESCRIPTION

Figure 1:
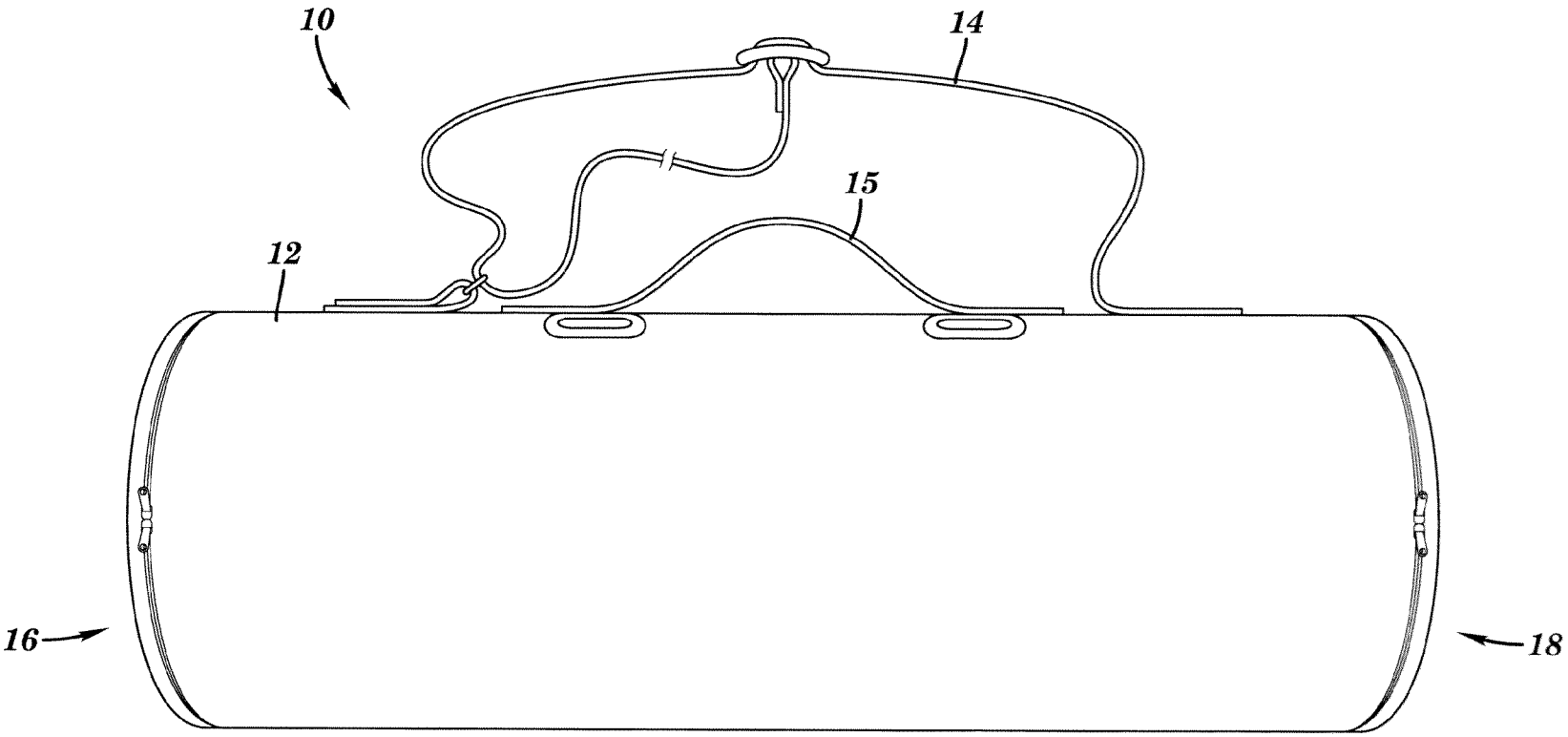
FIG. 1 is a lateral front perspective view of an example of a storage, transport, deployment and retraction bags, shown in a closed state.

An exemplary storage, transport, deployment and retraction bag 10(1) is illustrated in FIGS. 1-8. The storage, transport, deployment and retraction bag 10(1) includes a substantially tubular shaped sleeve 12, a holding and carrying strap 14, a carrying handle 15, a first opening 16 at a first end of sleeve 12, and a second opening 18 at a second end of sleeve 12, although the bag can comprise other types and numbers of components and elements in other shapes and configurations. This technology provides a number of advantages including providing a more efficient and effective bag for the storage, transport, deployment, and retraction of line, such as electrical extension cords, rope, and other cord-like or flexible tubular devices.

Referring more specifically to FIG. 1, the sleeve 12 defines a storage compartment for line and has a substantially tubular shape, although the sleeve could have other shapes, configurations and dimensions. The sleeve 12 has first and second openings 16 and 18 at opposing end which are substantially the same size to facilitate easy storage and deployment of line from either or both ends of the bag, although the bag could have other types and numbers of openings at other locations and with other dimensions. In this example, the sleeve 12 is made of lightweight flexible materials, such as vinyl, nylon, cotton duck, vinyl fabric, leather, vinyl, rubber, polymer mesh, and netting, although other types of materials could be used.

Sleeve 12 can be cut from a continuous roll of seamless tubular webbing, although sleeve can be manufactured in other manners. For example, sleeve 12 may be fabricated from a substantially rectangular sheet of fabric, joined at a seam by sewing, welding, or another fabric joining process to form a tubular structure, although other geometric shapes may be used.

In this example, the bag 10(1) includes an optional carrying strap 14 which is secured at each end to the sleeve 12 and is adjustable, although other types of carrying attachments could be used. In this example, the carry strap 14 is made of a fabric webbing material, such as nylon webbing, polyester webbing, or combinations thereof, although other types and numbers of materials, such as leather, could be used.

In this example, the bag 10(1) also includes an optional carrying handle 15 which is secured at each end to the sleeve 12. The carrying handle 15 is made of fabric webbing material, such as nylon webbing or polyester webbing, or combinations thereof, although other types and numbers of materials, such as leather, could be used.

Referring to FIGS. 2-4 and 8, the bag also includes optional mesh end caps 17 and 19, although other types of structures to secure for storage and also facilitate deployment and retraction of the line can be used. In this example, one edge of a mesh end cap 17 is secured about the boundary of opening 16 to sleeve 12 and an edge of mesh end cap 19 is secured about the boundary of opening 18 to sleeve 12, although other types and numbers of end caps or other closure elements made of other types of materials could be used. An inner edge 21 of the mesh end cap 17 defines a smaller opening to the storage compartment in sleeve 12 and an inner edge 23 of mesh end cap 19 defines another smaller opening to the storage compartment in sleeve 12.

In this example, a drawstring channel 30(1) is formed adjacent and substantially about the inner edge 21 of the mesh end cap 17 with a drawstring 24 movably disposed within channel 30(1) and each of the ends of drawstring 24 exposed. Another drawstring channel 30(2) is formed adjacent and substantially about inner edge 23 of the mesh end cap 19 with a drawstring 24 movably disposed within channel 30(2) with each of the ends of drawstring 24 exposed. With the drawstrings 22 and 24, the mesh end caps 17 and 19 the ends 16 and 18 of the sleeve 12 can be substantially opened and substantially closed, i.e. when substantially open the line can be accessed for either deployment or retraction out of or into the bag and when substantially closed the line in the bag can not be accessed for extraction. Although drawstrings 22 and 24 and drawstring channels 30(1) and 30(2) are shown, other types of mechanisms to substantially block or provide access to the storage compartment in sleeve 12 can be used. Each of the drawstrings 22 and 24 may also include drawstring locks 26 and 28 to secure drawstrings 22 and 24 to prevent mesh end caps 17 and 19 from opening, although these are optional and other types of locking mechanisms could be used.

Referring to FIGS. 1-8, the bag 10(1) also includes end flaps 46 and 47 which are detachably connected to the sleeve 12 adjacent openings 16 and 18 and are adjustable between a substantially open position providing access to the storage compartment in the sleeve 12 and a substantially closed position closing access to the storage compartment in the sleeve 12. In this example, end flap 46 is detachably secured about the opening 16 to sleeve 12 by zipper 40 using pull closures 42 and 44 and end flap 47 is detachably secured about the opening 18 to sleeve 12 by zipper 41 using pull closures 43 and 45, although other detachable securing mechanisms can be used.

A carabineer 48 is secured to an inner surface of end flap 46 to define a feed passage for line and carabineer 49 is secured to an inner surface of end flap 47 to define a feed passage for line, although other types and numbers of guidance mechanisms in other configurations and locations could be used. In this example, carabineer 48 is detachably secured to end flap 46 by passing carabineer through two grommets 50 and 51 in end flap 46, although other manners for securing the guidance mechanism could be used. Similarly, carabineer 49 is detachably secured to end flap 47 by passing carabineer through two grommets 52 and 53 in end flap 47, although other manners for securing the guidance mechanism could be used. When either of the end flaps 46 and 47 is in a substantially open position and is still partially connected to the sleeve 12 as shown in FIGS. 3-5 and 8, the corresponding carabineer 48 and 49 is spaced from the corresponding one of the adjacent openings 16 and 18 to provide greater stroke length for deploying line from or retracting line into the storage compartment in sleeve 12.

Figure 6:
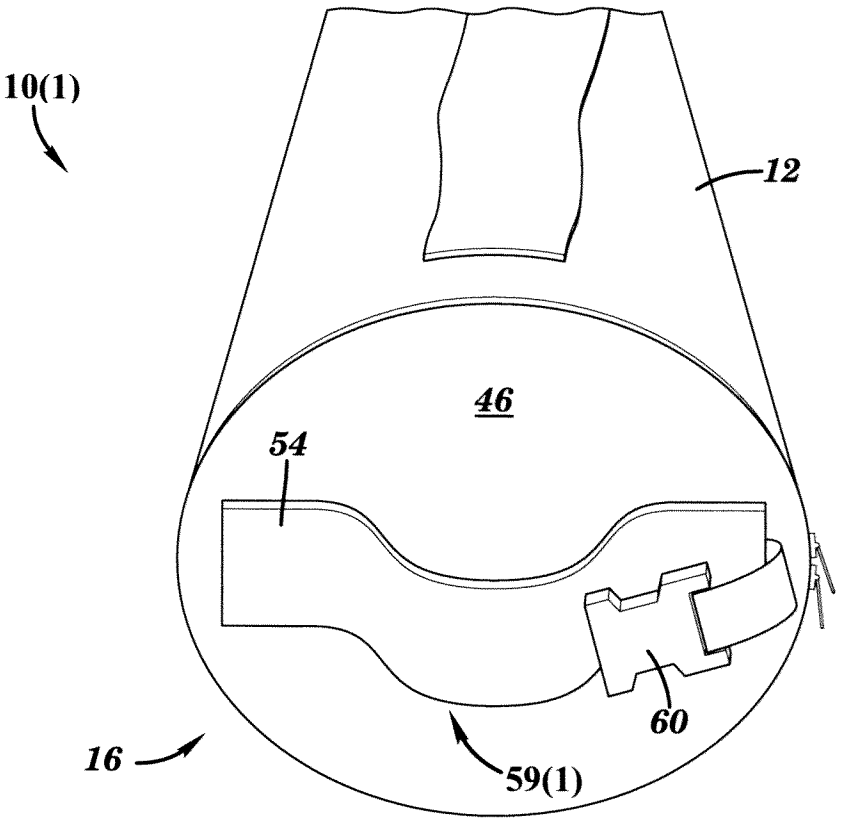
Figure 7:
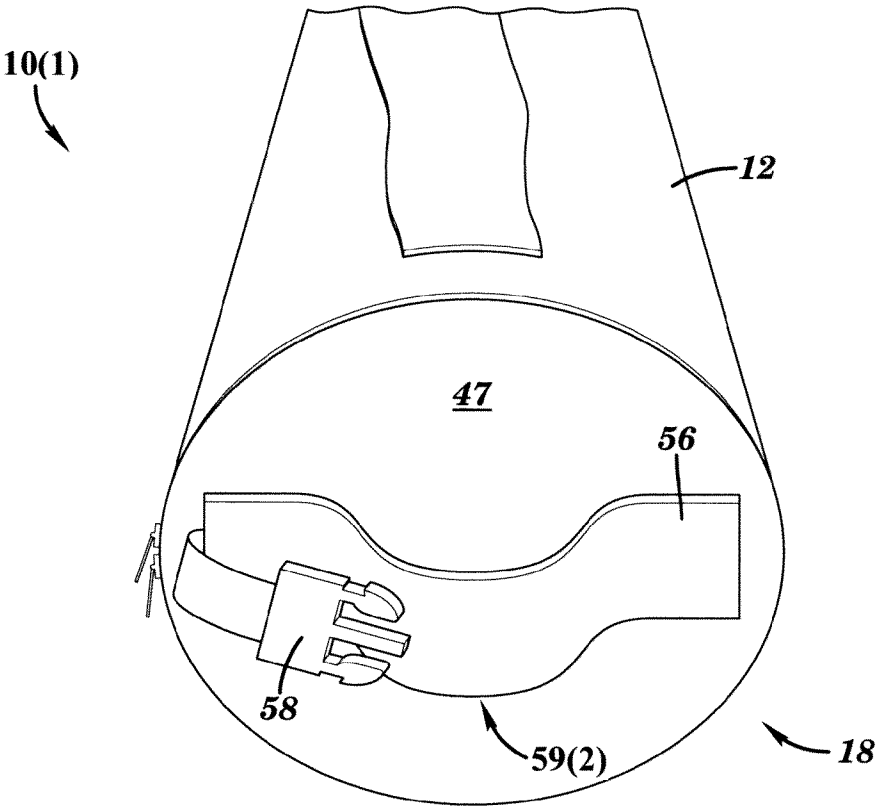

Referring to FIGS. 6-7, bag 10(1) may also include an optional strip of material 54 forming hand grip 59(1) secured to the end flap 46 and an optional strip of material 56 forming hand grip 59(2) secured to the end flap 47, although other types and number of hand grips could be used. In this example, each of the hand grips 59(1) and 59(2) comprises a strip of webbing secured at each end to the end flaps 46 and 47 and defining a passage sized to accommodate an operator's hand. The hand grips 59(1) and 59(2) help the operator to facilitate smooth loading of a line into bag 10(2) and to secure and stabilize the opposing end of the sleeve 12 from which the deployment or retraction of line is occurring.

Figure 8:
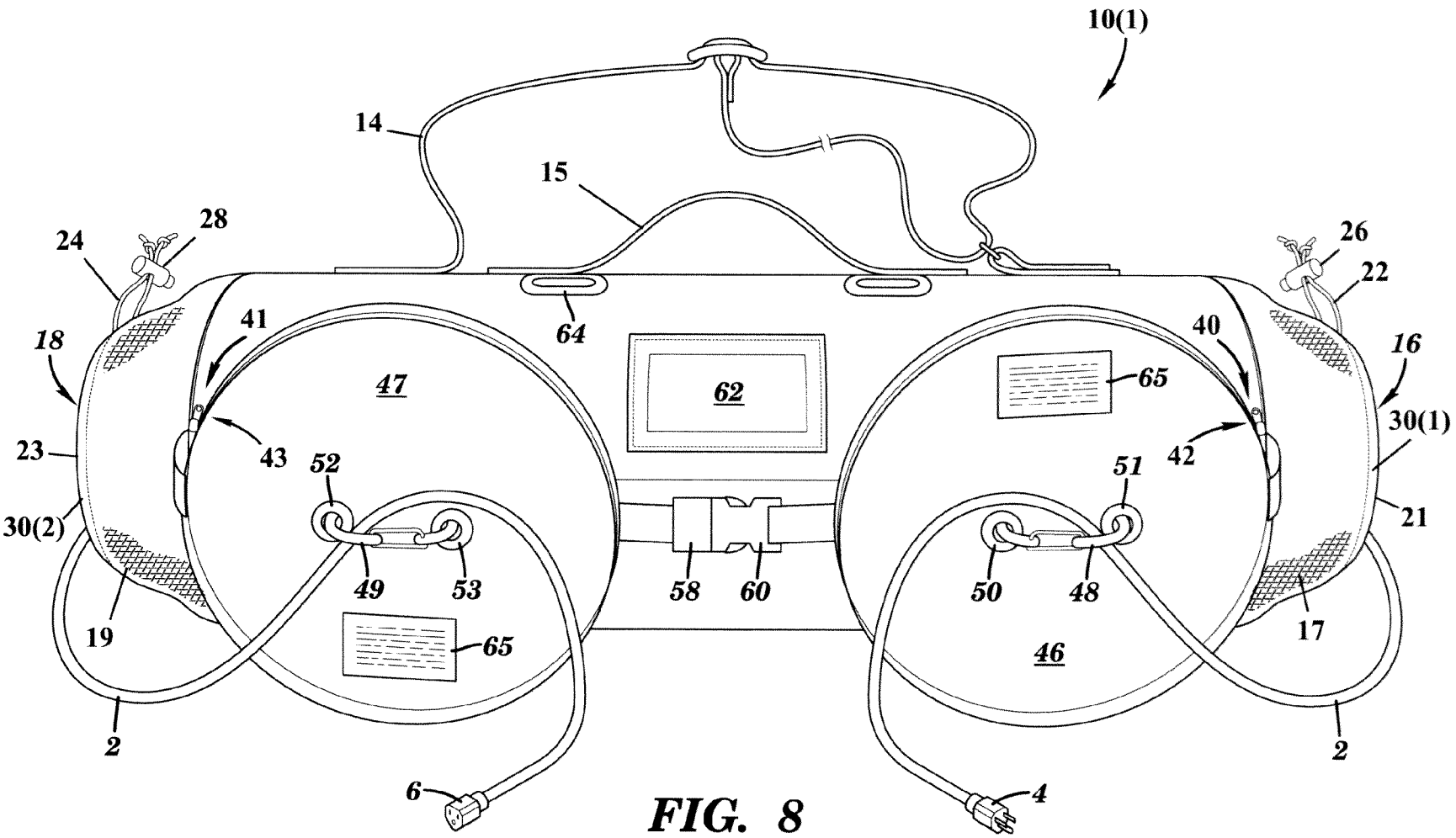

Referring to FIGS. 6-8, the end flaps 46 and 47 may also include a connecting strap with a female end 60 of a slide snap lock that is secured to flap 46 and another connecting strap with a male end 58 of a slide snap lock that is secured to flap 47, although other types of extensions, attachment mechanisms and dimensions could be used. As illustrated in FIG. 8, the male end 58 can detachably mate with the female end 60 to detachably secure the end flaps 46 and 47 together in a substantially open state to facilitate deployment or retraction of line with bag 10(1).

Referring to FIG. 8, bag 10(1) may also optionally include an identification holder 62 is shown along with venting grommets 64, and instruction labels 65, although other types and numbers of identification, venting and instruction features could be used.

Figure 9:
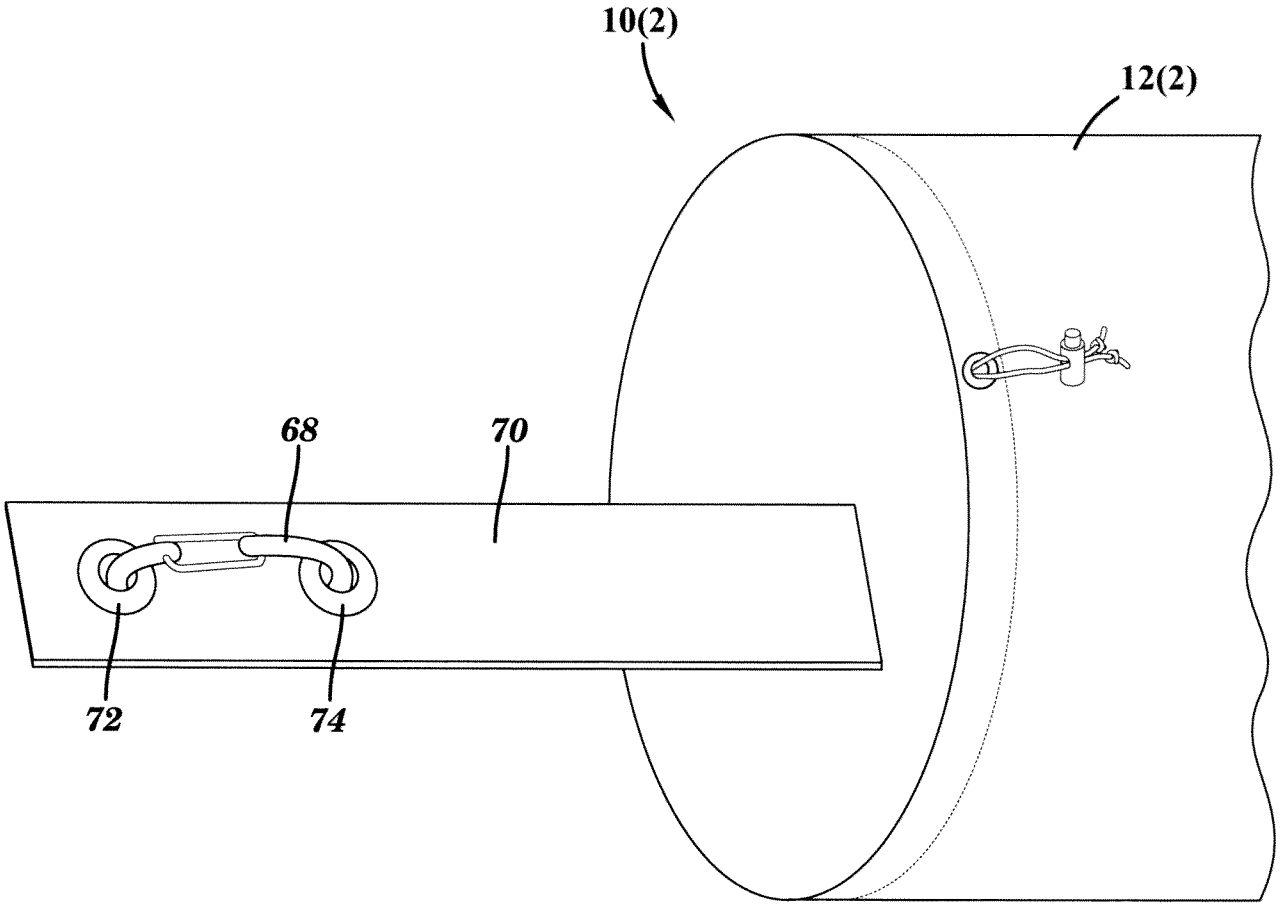
FIG. 9 illustrates an alternative example of the storage, transport, deployment and retraction bag 10 with a draw string closure in a lateral position.

Referring to FIG. 9, an alternative example of a bag 10(2) is illustrated. Bag 10(2) is the same in structure and operation as bag 10(1), except as illustrated and described herein. In this example, bag 10(2) includes strap 70 which is secured adjacent one end to an inner surface of the sleeve 12(2), although the strap 70 can be connect to sleeve 12(2) in other manners. The strap 70 has at least one position where the other end extends out and away from the sleeve 12(2). A carabineer 68 is detachably secured to strap 70 through grommets 72 and 74 and is spaced from opening 16 to provide a greater stroke length when deploying line from or retracting line into sleeve 12(2) and facilitate use of bag 10(2). Each end of bag 10(2) includes drawstrings having drawstring locks to secure bag and to prevent the respective ends from opening, although these are optional and other types of locking mechanisms could be used.

In the example shown in FIG. 9. The loading strap 70 is suitably joined to the side of the bag 10 on top of interior handle 32 adjacent ends 18 and (16 not shown.) Strap 70 can be continuous i.e., run through the length of and extend out the opposite ends of the bag; or strap 70 can be discontinuous i.e., separated straps that extend out of the opposite ends of the bag. Loading strap 70 may include a loading strap handle located opposite side of carabineer 68, which is similar to hand grips 59(1) and 59(2) of bag 10(1). The loading strap handles facilitates easier and faster loading of a line into bag 10(2) due to the length of product that can be loaded at once as well as increased security in the grip when also grasping the carabineer 68. The strap handle may be positioned to accommodate both right and left handed persons alike.

Although a carabineer 68, other types and numbers of line guidance devices could be. By way of example only, exemplary guidance devices 78, 88, and 98 which are easy to engage for use and assist an operator in effectively deploying and retracting line are illustrated and described below with reference to FIGS. 10-18.

Figure 10:
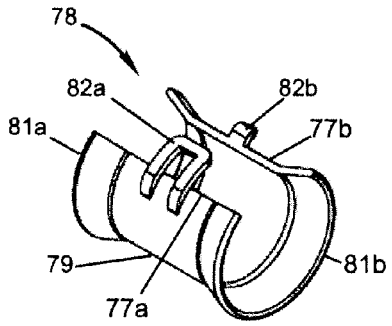
FIG. 10 is a front perspective view of a second example of the guidance device.
Figure 11:
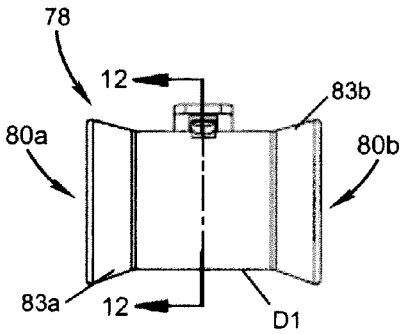
FIG. 11 is a side view of the second example of the guidance device shown in FIG. 10.
Figure 12:
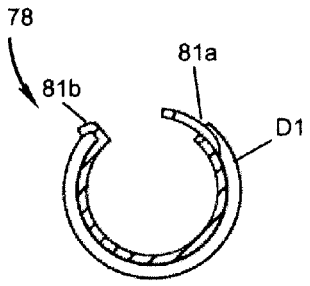
FIG. 12 is a cross-sectional view of the guidance device taken generally along line 12-12 of FIG. 11.
Figure 13:
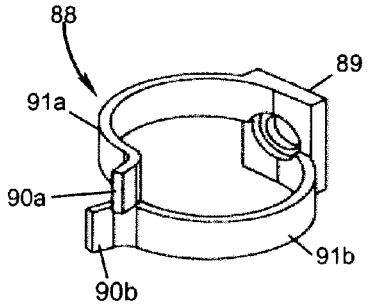
FIG. 13 is a front perspective view of a third example of the guidance device.
Figure 14:
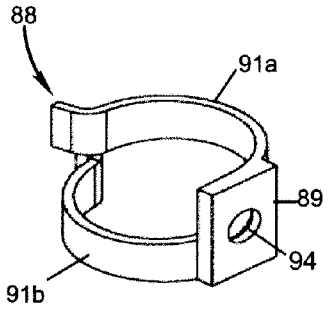
FIG. 14 is a rear perspective view of the third example of the guidance device shown in FIG. 13.
Figure 15:
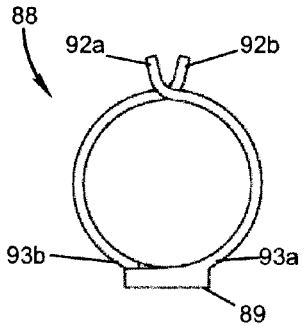
FIG. 15 is a top view of the third example of the guidance device shown in FIG. 13.

Referring to FIGS. 10-12, another example of a guidance device 78 is illustrated. The guidance device 78 includes an open tube 79 defining a passage with open ends 80*a* and 80*b* and having edges 77*a* and 77*b* extending along the length of the tube 79, although the guidance device can have other types and numbers of element in other configurations. The edges 77*a* and 77*b* of the tube 78 can be detachably brought together by bending the tube 79 and detachably mating female connector 82*a* and with male connector 82*b* on the tube 78 near edges 77*a* and 77*b*. Each of the open ends 80*a* and 80*b* of the tube 79 has a shape which flares out, i.e. a circumference of the passage 79 is smaller than an outer circumference at the outer edge of open ends 80*a* and 80*b*, to facilitate passing a line through the guidance device 78 in either direction Referring to FIGS. 13-15, another example of a guidance device 88 is illustrated. The guidance device 88 includes a base member 89 and spaced apart resilient fingers 91*a* and 91*b* which extend out from the base member 89, although the guidance device could comprise other types and numbers of elements in other configurations. The base member 89 includes an aperture 94 to receive a mounting post with a head at one end which is larger than the aperture 94 and another end secured to strap 70 to pivotally mount the guidance device 88. In this example, the spaced apart resilient fingers 91*a* and 91*b* have an arc shape with ends 93*a* and 93*b* secured to the base member 89 and overlap at ends 90*a* and 90*b* of fingers 91*a* and 91*b*, although the fingers could have other arrangements, such as a non-overlapping configuration.

Figure 16:
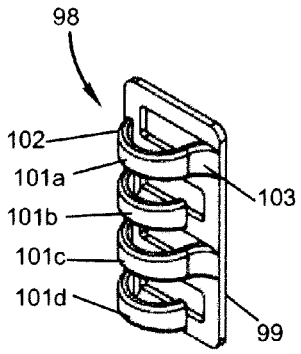
FIG. 16 is a front perspective view of a fourth example of the guidance device.
Figure 17:
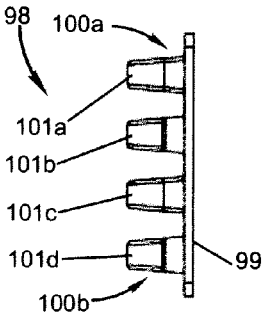
FIG. 17 is a right side view of the fourth example of the guidance device shown in FIG. 16; and, FIG. 18 is a top view of the fourth example of the guidance device shown in FIG. 16.
Figure 18:
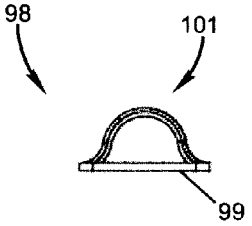

Referring to FIGS. 16-18, guidance device 98 including base member 99 having at least two open ends 100*a* and 100*b*, and plurality of arc-shaped fingers 101*a-d* extending out from base 99 to define an elongated guidance passage. Each of the fingers 101*a-d* includes a free end 102 and non-free end 103 secured to the base 99 and in this example are arranged in a spaced apart and overlapping relationship. The free ends 102 of the fingers 101*a-d* are adapted to be deflectable generally outwardly to receive or withdraw a line from guidance device 98.

Figure 2:
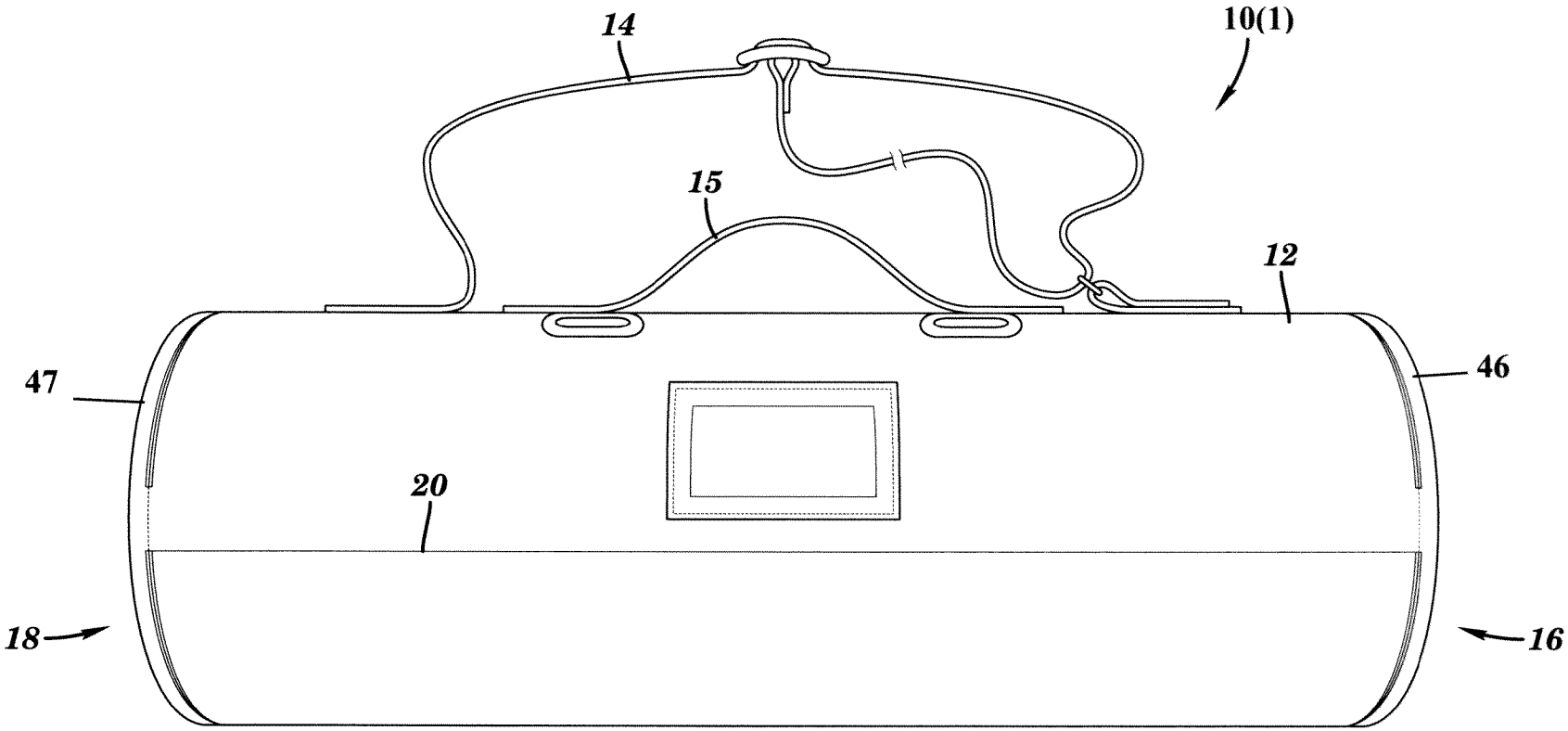
FIG. 2 is a lateral rear perspective view of an example of a storage, transport, deployment and retraction bags, shown in a closed state.
Figure 3:
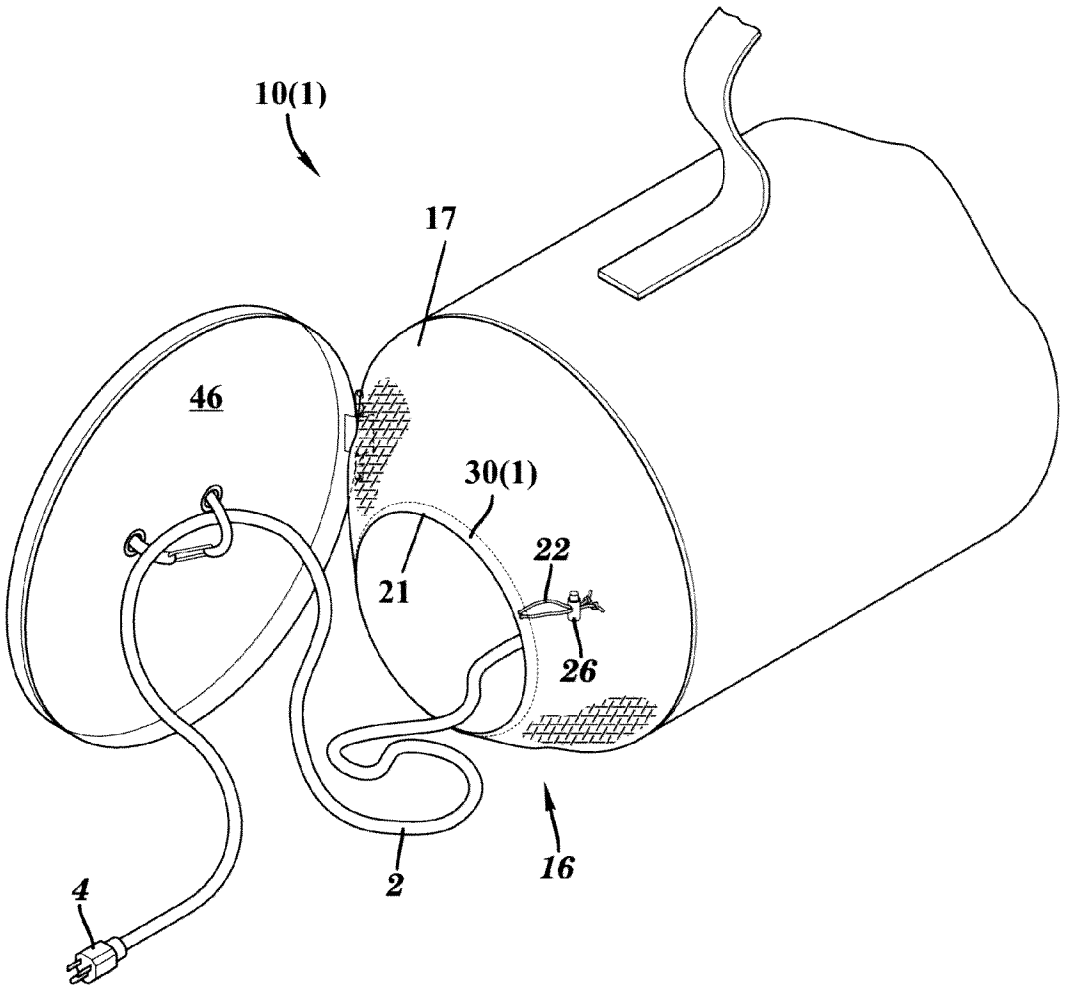
FIG. 3 is a oblong perspective view of one example of the storage, transport, deployment and retraction bag shown in an opened state, at the initial state of withdrawal of a line contained therein.
Figure 4:
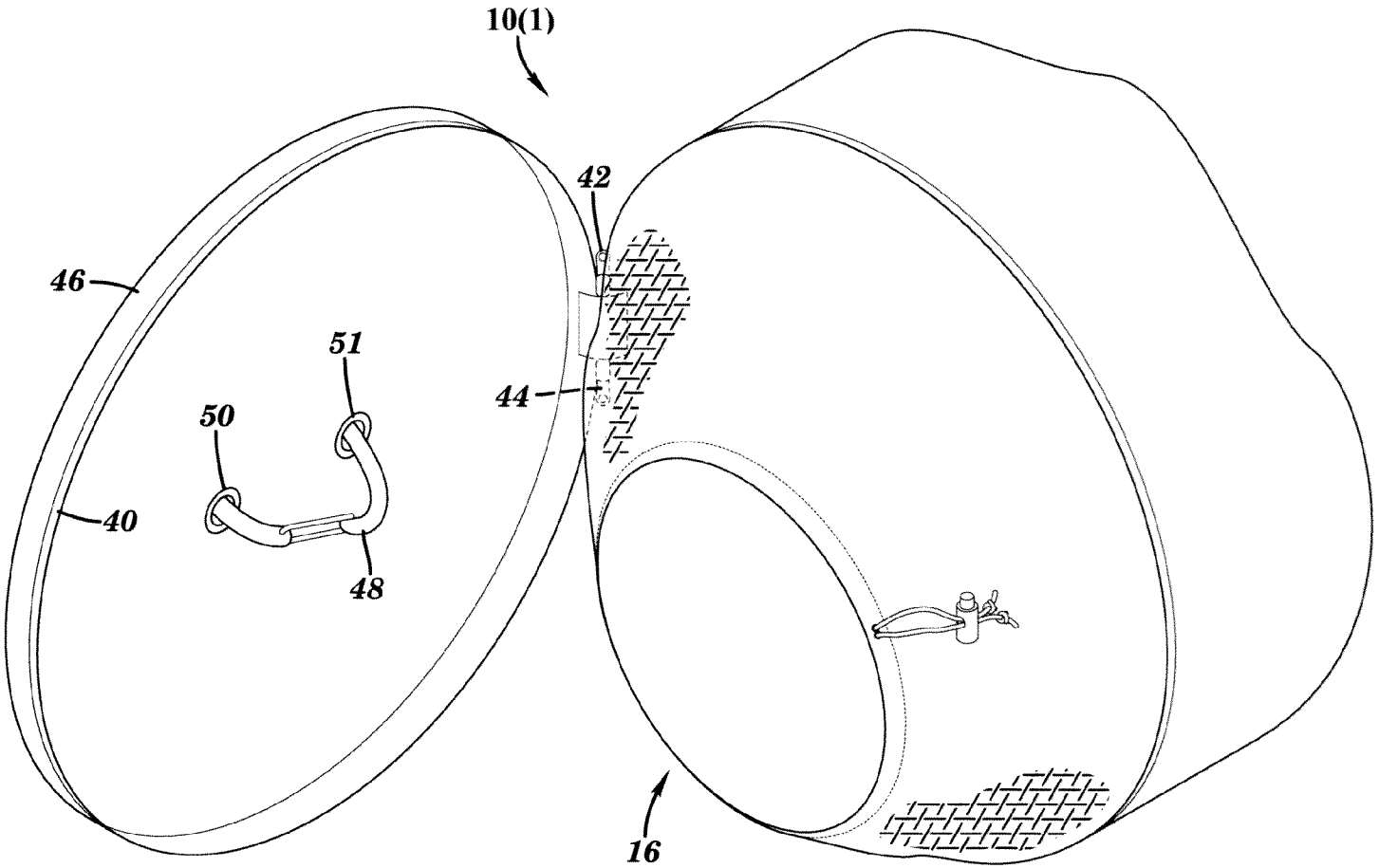
Figure 5:
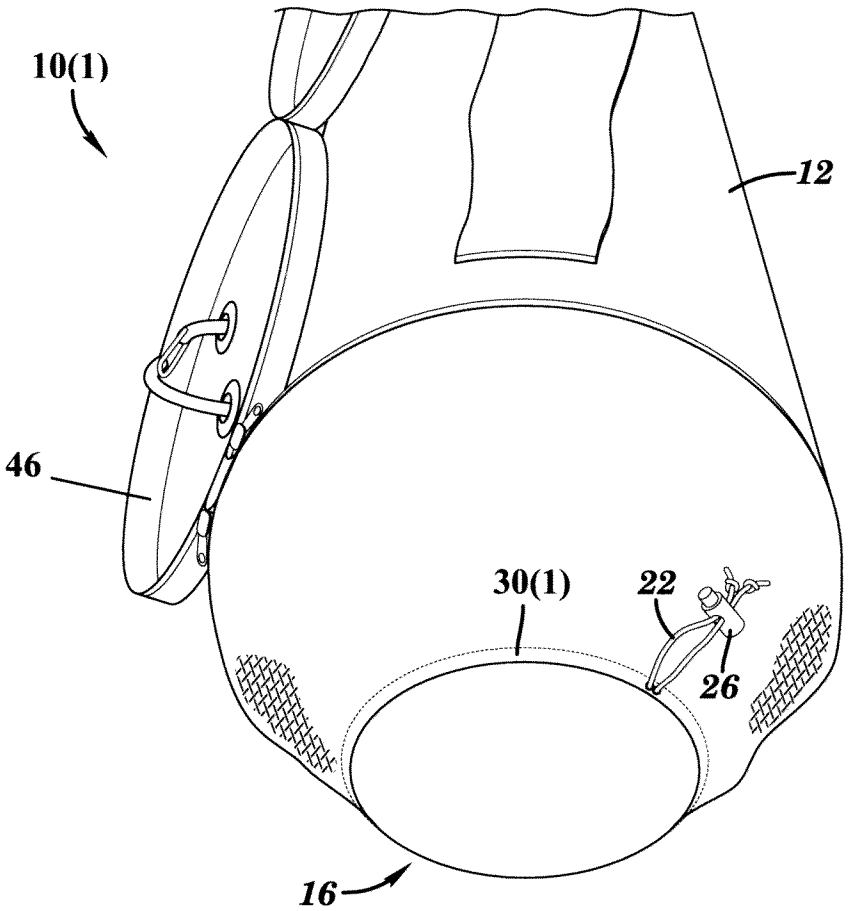

A method for storing, transporting, deploying, and retracting line with bag 10(1) will now be described with reference to FIGS. 1-8. Line can be easily and effectively stored in a clutter free manner in bag 10(1) as shown in FIGS. 1 and 2. When an operator needs to use the line, the bag 10(1) can easily be transported to the desired location using optional carrying strap 15, which is adjustable, or optional handle 15. Additionally, hand grips 59(1) and 59(2) could also be used to transport bag 10(1).

To deploy line from bag 10(1), one or both of the pull closures 42 and 44 can be used to unzip zipper 40 and substantially open end flap 46 to provide access to opening 16 of sleeve 12, although other manners for accessing opening 16 or opening 18 could be used.

In this example, the bag 10(1) also includes a mesh end cap 17. To deploy line, the drawstring lock 26 is released and drawstring 22 is loosened in drawstring channels 30(1), although other types of mechanisms to provide access to the storage compartment in sleeve 12 can be used.

When the zipper 40 is opened, the end flap is still connected to the sleeve 12 and in this example includes a carabineer 48 which is spaced away from the opening 16, although other types of guidance devices could be used, such as one of the ones illustrated in FIGS. 10-18. Next, the end of the line 2 is retrieved from the storage compartment of sleeve 12 and is fed through the carabineer 48 on end flap 46. The distance of the carabineer 48 from the opening 16 helps to provide a greater stroke length for the operator to efficiently deploy line from bag 10(1). The operator may also place his other hand in hand grip 59(2) to stabilize and support sleeve 12 and facilitate deployment of line.

If the operator would like to deploy line 2 from both openings 16 and 18 in sleeve 12, then both end flaps 46 and 47 may be opened. To prevent the end flaps 46 and 47 from interfering with deployment, a female end 60 connected to flap 46 and male end 58 of a slide snap lock secured to flap 47 may be mated together as shown in FIG. 8. When retraction is to be performed line 2 is placed within and detachably secured within the guidance mechanism then directed into bag 10 through the guidance mechanism. The guiding effect of which enacts an easier retraction of line 2 from either end 16, 18 of bag 10.

The operation of bag 10(2) is identical to the operation of bag 10(1), except as illustrated and described herein. With bag 10(2), the carabineer is located on the strap 70 which can be pulled out of either end of sleeve 12, threaded with line 2 and then used to facilitate the stroke length for deploying or retracting line 2.

As illustrated and described with the examples herein, this technology provides for the compact storage, efficient transport, and easy deployment or retraction of a line at a work site or recreational uses. It will be apparent that this bag has numerous other uses in the storage, transport, deployment and retraction of a variety of different types of lines, such as electrical cord, Christmas lights, rope lights, air hose, water hoses, plastic tubing, audio/visual cables, and ski and tubing rope and anchor lines by way of example only.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed is:

1. A device for storage, transport, deployment and retraction of line, the device comprising:

a sleeve which defines a storage compartment and has an opening adjacent at least one end;

a closure apparatus disposed in the sleeve adjacent the opening, the closure apparatus configured to adjust the opening to a position ranging from substantially closed to substantially open;

a sleeve end member with an extended section between a first edge portion secured adjacent to the one end of the sleeve and an opposing second edge portion; and at least one guide mechanism device is provided adjacent the opposing second edge portion in the extended section of the sleeve end member to facilitate with the extended section of the sleeve end member a stroke length for the deployment and retraction of the line;

wherein the sleeve end member is a strap member which is secured adjacent the first edge portion to the sleeve and has at least one position where the strap member extends out from the inside of the sleeve and the at least one guide mechanism device is connected to the strap member at a distance away from the opening of the sleeve.

2. The device as set forth in claim 1 wherein the sleeve has another opening adjacent an opposing end and further comprises:

another sleeve end member with another extended section between another first edge portion secured adjacent to the opposing end of the sleeve and another opposing second edge portion; and another guide mechanism device in the extended section of the end member adjacent the opposing second edge portion to facilitate with the extended section of the another sleeve end member the stroke length for the deployment and retraction of the line.

3. The device as set forth in claim 1 further comprising at least one end cap connected to the sleeve adjacent the one end, the end cap defining another opening to the sleeve, the closure apparatus configured to adjust the another opening in the end cap to a position ranging from substantially closed to substantially open.

4. The device as set forth in claim 3 wherein the closure apparatuses comprises a drawstring movably disposed in a channel formed in the end cap adjacent the another opening.

5. The device as set forth in claim 1 further comprising at least one hand grip connected to the sleeve adjacent an opposing end from the opening.

6. The device as set forth in claim 1 wherein the at least one guide mechanism device further comprises a housing which defines an elongated path for the passage and an opening extending along the elongated path to the passage.

7. The device as set forth in claim 6 wherein the housing further comprises a tube with the opening extending along the elongated path to the passage and a detachable securing device configured to detachably retain the housing in a closed position with respect to the opening extending along the elongated path to the passage.

8. The device as set forth in claim 6 wherein the housing further comprises one or more arc shaped fingers extending out from a base to define the elongated path for the passage.

9. A device for storage, transport, deployment and retraction of line, the device comprising:

a sleeve which defines a storage compartment and has an opening adjacent at least one end;

a closure apparatus disposed in the sleeve adjacent the opening, the closure apparatus configured to adjust the opening to a position ranging from substantially closed to substantially open;

a sleeve end member with an extended section between a first edge portion secured adjacent to the one end of the sleeve and an opposing second edge portion; and at least one guide mechanism device is provided adjacent the opposing second edge portion in the extended section of the sleeve end member to facilitate with the extended section of the sleeve end member a stroke length for the deployment and retraction of the line;

wherein the sleeve end member is an end flap at least partially detachably connected to the sleeve adjacent the first edge portion and adjustable between a substantially open position providing access to the opening to the sleeve and spacing the at least one guide mechanism device at a distance away from the opening of the sleeve and a substantially closed position closing access to the opening to the sleeve.

10. The device as set forth in claim 9 wherein the at least one guide mechanism device is connected to the end flap at a location which is spaced away from the opening to the sleeve when the end flap is in the substantially open position and is still partially connected to the sleeve.

11. The device as set forth in claim 9 wherein the sleeve has another opening adjacent an opposing end and further comprises another end flap at least partially detachably connected to the sleeve adjacent the opposing end and adjustable between a substantially open position providing access to the another opening to the sleeve and a substantially closed position closing access to the another opening to the sleeve.

12. The device as set forth in claim 11 further comprising another one of the guide mechanism devices connected to the end flap at a location which is spaced away from the opening to the sleeve when the another end flap is in the substantially open position and is still partially connected to the sleeve.

13. The device as set forth in claim 11 further comprising a detachable locking apparatus to detachably secure the end flap and the another end flap together when the end flap and the another end flap are each in the substantially open position.

14. A method for making a device for storage, transport, deployment and refraction of line, the method comprising:

providing a sleeve which defines a storage compartment and has an opening adjacent at least one end;

disposing a closure apparatus in the sleeve adjacent the opening, the closure apparatus configured to adjust the opening to a position ranging from substantially closed to substantially open;

securing a first edge portion of an extended section of a sleeve end member adjacent to the one end of the sleeve and a second edge portion, the extended section of the sleeve end member having an opposing second edge portion; and providing at least one guide mechanism device adjacent the opposing second edge portion in the extended section of the sleeve end member to facilitate with the extended section of the sleeve end member a stroke length for the deployment and retraction of the line;

wherein the sleeve end member is a strap member secured adjacent to the first edge portion to the sleeve, the strap member has at least one position where the strap member extends out from the inside of the sleeve and the at least one guide mechanism device is at a location which is spaced away from the opening to the sleeve.

15. The method as set forth in claim 14 wherein the sleeve has another opening adjacent an opposing end and further comprises:

securing a first edge portion of another extended section of another sleeve end member adjacent to the opposing end of the sleeve and a second edge portion, the another extended section of the another sleeve end member having another opposing second edge portion; and providing another guide mechanism device in the another extended section of the another sleeve end member adjacent the opposing second edge portion to facilitate with the another extended section of the another sleeve end member the stroke length for the deployment and retraction of the line.

16. The method as set forth in claim 14 further comprising connecting at least one end cap to the sleeve adjacent the one end, the end cap defining another opening to the sleeve, the closure apparatus configured to adjust the another opening in the end cap to a position ranging from substantially closed to substantially open.

17. The method as set forth in claim 16 wherein the closure apparatuses comprises a drawstring movably disposed in a channel formed in the end cap adjacent the another opening.

18. The method as set forth in claim 14 further comprising connecting at least one hand grip to the sleeve adjacent an opposing end from the opening.

19. The method as set forth in claim 14 wherein the connecting at least one guide mechanism device further comprises connecting at least one guide mechanism which comprises a housing that defines an elongated path for the passage and has an opening extending along the elongated path to the passage.

20. The method as set forth in claim 19 wherein the housing further comprises a tube with the opening extending along the elongated path to the passage and a detachable securing device configured to detachably retain the housing in a closed position with respect to the opening extending along the elongated path to the passage.

21. The method as set forth in claim 19 wherein the housing comprises one or more arc shaped fingers extending out from a base to define the elongated path for the passage.

22. A method for making a device for storage, transport, deployment and retraction of line, the method comprising:

providing a sleeve which defines a storage compartment and has an opening adjacent at least one end;

disposing a closure apparatus in the sleeve adjacent the opening, the closure apparatus configured to adjust the opening to a position ranging from substantially closed to substantially open;

securing a first edge portion of an extended section of a sleeve end member adjacent to the one end of the sleeve and a second edge portion, the extended section of the sleeve end member having an opposing second edge portion; and providing at least one guide mechanism device adjacent the opposing second edge portion in the extended section of the sleeve end member to facilitate with the extended section of the sleeve end member a stroke length for the deployment and retraction of the line;

wherein the sleeve end member is an end flap partially detachably connected to the sleeve adjacent the first edge portion to be adjustable between a substantially open position providing access to the opening to the sleeve and spacing the at least one guide mechanism device at a distance away from the opening of the sleeve and a substantially closed position closing access to the opening to the sleeve.

23. The method as set forth in claim 22 wherein the providing at least one guide mechanism device further comprise providing the at least one guide mechanism device in the end flap at a location which is spaced away from the opening to the sleeve when the end flap is in the substantially open position and is still partially connected to the sleeve.

24. The method as set forth in claim 22 wherein the sleeve has another opening adjacent an opposing end and further comprises at least partially detachably connecting another end flap to the sleeve adjacent the opposing end, the another end flap is adjustable between a substantially open position providing access to the another opening to the sleeve and a substantially closed position closing access to the another opening to the sleeve.

25. The method as set forth in claim 24 further comprising connecting another one of the guide mechanism devices to the end flap at a location which is spaced away from the opening to the sleeve when the another end flap is in the substantially open position and is still partially connected to the sleeve.

26. The method as set forth in claim 24 further comprising detachably securing the end flap and the another end flap together with a detachable locking apparatus when the end flap and the another end flap are each in the substantially open position.

* * * * *